US008137145B2

(12) United States Patent
Joy

(10) Patent No.: US 8,137,145 B2
(45) Date of Patent: Mar. 20, 2012

(54) WIRING TERMINATION MECHANISMS AND USE THEREOF

(75) Inventor: Edward Joy, Bronx, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 12/474,874

(22) Filed: May 29, 2009

(65) Prior Publication Data

US 2010/0304619 A1 Dec. 2, 2010

(51) Int. Cl.
*H01R 4/50* (2006.01)

(52) U.S. Cl. ..... 439/864

(58) Field of Classification Search ..... 439/864, 439/863, 441, 536, 107, 106, 725, 656
See application file for complete search history.

(56) References Cited

U.S. PATENT DOCUMENTS

| | | | | |
|---|---|---|---|---|
| 1,994,880 | A | 3/1935 | Wallbillich | |
| 2,015,858 | A | 10/1935 | Leviton | |
| 2,082,994 | A | 6/1937 | Wallbillich | |
| 2,163,722 | A | 6/1939 | Wallbillich | |
| 2,175,098 | A | 10/1939 | Wertzheiser | |
| 2,201,743 | A | 5/1940 | Petersen | |
| 2,201,751 | A | 5/1940 | Wertzheiser | |
| 2,238,386 | A * | 4/1941 | Frank | 439/409 |
| 2,463,033 | A * | 3/1949 | Harnett | 439/721 |
| 2,466,930 | A | 4/1949 | Cook | |
| 2,506,212 | A | 5/1950 | Grohsgal | |
| 2,556,491 | A * | 6/1951 | De Lorenzo | 439/838 |
| 2,763,847 | A | 9/1956 | Hubbell | |
| 2,952,831 | A | 9/1960 | Ehrlich | |
| 3,431,546 | A | 3/1969 | Averill | |
| 3,439,315 | A | 4/1969 | Hamel et al. | |
| 3,660,728 | A | 5/1972 | Carter | |
| 3,713,071 | A | 1/1973 | Poliak et al. | |
| 3,740,613 | A | 6/1973 | Strachan | |
| 3,793,607 | A | 2/1974 | Smith et al. | |
| 3,904,266 | A | 9/1975 | Fitzpatrick | |
| 3,944,314 | A | 3/1976 | Weitzman et al. | |
| 3,945,711 | A | 3/1976 | Hohorst et al. | |

(Continued)

FOREIGN PATENT DOCUMENTS

| | | |
|---|---|---|
| CA | 981354 | 1/1976 |

(Continued)

OTHER PUBLICATIONS

PCT Notification of Transmittal of the International Search Report and the Written Opinion of the International Searching Authority for PCT/US2007/007596, dated Sep. 10.

(Continued)

*Primary Examiner* — Phuong Dinh
(74) *Attorney, Agent, or Firm* — Carter, DeLuca, Farrell & Schmidt, LLP

(57) ABSTRACT

New wiring terminations and methods are disclosed. The terminations may be incorporated into any suitable device such as wiring device which comprises a housing having a plurality of wire terminations. At least one of the plurality of wire terminations comprises a conductive surface and an element. The conductive surface is at least partially disposed within the housing. The element is movably mounted at least partially within the housing and is tool-lessly movable between at least a first position and a second position. The first position of the element actuates the termination such that the termination receives a wire and the second position of the element actuates the termination to removably clamp the wire.

23 Claims, 10 Drawing Sheets

U.S. PATENT DOCUMENTS

| | | | | |
|---|---|---|---|---|
| 3,999,829 | A * | 12/1976 | Glaesel | 439/437 |
| 4,060,305 | A | 11/1977 | Poliak et al. | |
| 4,099,826 | A | 7/1978 | Mazzeo et al. | |
| 4,172,628 | A | 10/1979 | Lingaraju | |
| 4,255,655 | A | 3/1981 | Kikuchi | |
| 4,296,987 | A | 10/1981 | Lingaraju | |
| 4,372,693 | A | 2/1983 | Lutz | |
| 4,537,560 | A | 8/1985 | Emeterio et al. | |
| 4,759,726 | A * | 7/1988 | Naylor et al. | 439/441 |
| 4,767,340 | A | 8/1988 | Hohorst | |
| 4,793,823 | A | 12/1988 | Cozzens et al. | |
| 4,886,472 | A | 12/1989 | Tsai | |
| 4,995,829 | A | 2/1991 | Geib et al. | |
| 5,015,201 | A | 5/1991 | Brezee et al. | |
| 5,181,310 | A | 1/1993 | Josephson | |
| 5,262,749 | A | 11/1993 | Kopelman | |
| 5,637,011 | A | 6/1997 | Meyerhoefer et al. | |
| 5,825,602 | A | 10/1998 | Tosaka et al. | |
| 5,866,844 | A | 2/1999 | Osterbrock et al. | |
| 5,975,940 | A | 11/1999 | Hartmann et al. | |
| 5,995,350 | A | 11/1999 | Kopelman | |
| 6,049,143 | A | 4/2000 | Simpson et al. | |
| 6,368,149 | B1 | 4/2002 | Schmidt et al. | |
| 6,388,216 | B1 | 5/2002 | Puhalla et al. | |
| 6,406,323 | B2 | 6/2002 | Chung Long Shan | |
| 6,477,021 | B1 | 11/2002 | Haun et al. | |
| 6,689,955 | B2 | 2/2004 | Doutaz | |
| 6,707,652 | B2 | 3/2004 | Engel | |
| 6,712,641 | B2 | 3/2004 | Beege et al. | |
| 6,743,029 | B1 | 6/2004 | Greene et al. | |
| 6,750,402 | B2 | 6/2004 | Geske | |
| 6,786,779 | B2 | 9/2004 | Feldmeier et al. | |
| 6,802,747 | B1 | 10/2004 | Orange | |
| 6,827,602 | B2 | 12/2004 | Greene et al. | |
| 6,861,189 | B1 | 3/2005 | Greene et al. | |
| 6,926,543 | B2 | 8/2005 | Poh et al. | |
| 6,943,310 | B2 | 9/2005 | Eisenhower | |
| 6,948,846 | B2 | 9/2005 | Engel | |
| 7,052,335 | B2 | 5/2006 | Matsuura et al. | |
| 7,097,518 | B2 | 8/2006 | Kraemer et al. | |
| 7,103,968 | B2 | 9/2006 | Karrasch | |
| 7,114,986 | B1 | 10/2006 | Toly | |
| 7,115,001 | B1 | 10/2006 | Brockman et al. | |
| 7,118,404 | B2 | 10/2006 | Ploesser | |
| 7,140,887 | B2 | 11/2006 | Poh et al. | |
| 7,150,646 | B2 | 12/2006 | Trumper | |
| 7,164,082 | B2 | 1/2007 | Kurek et al. | |
| 7,175,485 | B1 | 2/2007 | Alderson et al. | |
| 7,241,188 | B2 | 7/2007 | Lin et al. | |
| 7,249,963 | B2 | 7/2007 | Ramm | |
| 7,270,581 | B2 | 9/2007 | Tiberio | |
| 7,547,226 | B2 | 6/2009 | Koessler | |
| 7,651,363 | B2 | 1/2010 | Koellmann | |
| 2004/0077210 | A1 | 4/2004 | Kollmann | |
| 2005/0090159 | A1 | 4/2005 | Luther et al. | |
| 2005/0212646 | A1 | 9/2005 | Watchorn | |
| 2006/0028316 | A1 | 2/2006 | Fabian et al. | |
| 2006/0288140 | A1 | 12/2006 | Lin | |
| 2007/0026701 | A1 | 2/2007 | Kurek et al. | |
| 2007/0238348 | A1 | 10/2007 | Kopelman | |
| 2008/0013239 | A1 | 1/2008 | Kopelman | |

FOREIGN PATENT DOCUMENTS

| | | | |
|---|---|---|---|
| CA | 1202095 | | 3/1986 |
| CA | 1203591 | | 4/1986 |
| CA | D60972 | | 5/1988 |
| DE | 550 863 | C | 5/1932 |
| EP | 01553660 | A1 | 7/2005 |
| EP | 01490928 | B1 | 10/2005 |
| EP | 1608039 | A1 | 12/2005 |
| FR | 2 312 767 | | 12/1976 |
| GB | 2 292 850 | A | 3/1996 |
| GB | 2 393 043 | A | 3/2004 |
| JP | 61 014529 | A | 1/1986 |
| WO | WO 97/03480 | | 1/1997 |

OTHER PUBLICATIONS

PCT International Search Report for PCT/US/2007/009433 dated Dec. 20, 2007.

Wago Innovative Connections, Wago Main Selection Page, www.connex-electronics.com/html/products/wago_main_select.html.

Wago Innovative Connections, The Wago Cage Clamp Technology, Electrical Interconnections.

Wago Innovative Connections, 773 Pushwire Connectors, for 10 AWG, Electrical Interconnections.

Wago Innovative Connections, LEVER-NUTS, 222 Series: 3 or 5 COnductor Compact Connectors, Electrical Interconnections.

* cited by examiner

WIRING TERMINATION MECHANISMS AND USE THEREOF

BACKGROUND

1. Technical Field

The present disclosure relates to electrical distribution wiring devices, and in particular, to electrical distribution wiring devices having novel wire termination mechanisms.

2. Description of Related Art

Electrical distribution wiring devices are typically provided with device terminations for terminating electrical conductors/wires, for example, load terminations, line terminations, ground terminations, etc. Together these terminations, depending on the mechanical configuration, may be connected to electrical conductors/wires using several presently known termination techniques. One such termination is referred to as "side-wire" (sometimes referred to as "wrap-wire") termination. To terminate a conductor/wire using a side-wire terminal, an end of the wire is initially stripped, exposing a portion of the end of the wire, and this exposed portion is then wrapped around a terminal screw. The screw is then tightened causing the head of the screw to secure the exposed wire between the head of the screw and a metallic terminal plate (e.g., a brass terminal).

Another type of wire termination is referred to as "back-wire" (also referred to as "clamp-wire"). In back-wire terminals, a screw passes through a first metallic plate and threads into a second metallic plate (referred to as a clamp) to compress a wire therebetween. The first metallic plate (or brass terminal) has a clearance opening and slides along the shaft of the screw. The second metallic plate has a threaded hole which the screw threads engage. A stripped wire is placed between the two metallic plates and the screw is tightened to compress the wire between the plates.

Yet another type of wire termination is referred to as a "push in" termination. Push-in terminations are terminals in which a small hole is available in the outer housing of a wiring device for insertion of a stripped wire therethrough. A solid-metal wire is initially stripped (e.g.—about five-eights of an inch) from the cut end. The stripped portion of the wire is inserted into the hole. A clamping mechanism, commonly in the form of a cage clamp, provides a clamping force on the wire to maintain it in contact with a terminal plate for establishing electrical contact with the wire. The clamping mechanism provides resistance against the wire being pulled out of the hole and out of contact with the terminal plate. Typically, a tool is required to release the wire; e.g., a screwdriver.

In view of the foregoing, it is desirable for wiring devices including termination mechanisms and methods of termination that provide convenient electrical terminations for various gauge conductors/wires.

SUMMARY

The present disclosure relates to an electrical distribution wiring device comprising a housing having a plurality of wire terminations, where at least one of the plurality of wire terminations comprises a collar and a manually operable actuator. The collar is at least partially disposed within the housing. The manually operable actuator is movably mounted at least partially within the housing and is movable between at least a first position and a second position. Movement of the actuator to the first position actuates the collar such that the collar may receive a wire and movement of the actuator to the second position of the actuator actuates the collar to removably clamp the wire.

In disclosed embodiments, the actuator further includes a cam, wherein actuation of the actuator from its first position towards its second position causes a circumferential opening of the collar to decrease.

In disclosed embodiments, the manually operable actuator is a hand operable actuator.

The present disclosure also relates to an electrical distribution wiring device comprising a housing having a plurality of wire terminations, where at least one of the plurality of wire terminations comprises a conductive surface and a lever. The conductive surface is at least partially disposed within the housing. The lever is rotationally mounted to the housing and is manually rotatable between at least a first position and a second position. The lever includes an eccentric surface. The first position allows a wire to be inserted into the wire termination and the second position causes the eccentric surface to selectively secure the wire against the conductive surface.

In disclosed embodiments, the wire termination has a second axis defined in relation thereto. An axis of the wire is substantially co-linear with the second axis when the wire is selectively inserted between the conductive surface and the lever.

In disclosed embodiments, actuation of the lever from its first position towards its second position causes the distance between the conductive surface and the eccentric surface to decrease.

In disclosed embodiments, the wire termination mechanism includes a resilient member disposed in mechanical cooperation with the lever. The resilient member is configured to accommodate a plurality of wire gauges.

In disclosed embodiments, the lever is manually rotatable by hand.

The present disclosure also relates to a method for terminating a wire to an electrical distribution device. The method comprises manually moving an element to allow a portion of a wire to be inserted between a conductive surface and at least a portion of the element, inserting a portion of a wire between the conductive surface and the element, and manually moving the element to removably secure the wire between the conductive surface and the element such that the wire is manually removable from between the conductive surface and the element.

In disclosed embodiments, the method also includes the step of manually moving the element to allow the wire to be removed from the electrical device.

In disclosed embodiments, the step of manually moving the element to secure the wire between the conductive surface and a portion of the element causes an eccentric surface of the element to move closer to the conductive surface.

The present disclosure also relates to an electrical distribution wiring device comprising a housing an a plurality of wire terminations disposed at least partially with the housing. The housing has at least one lever arm. At least one of the plurality of wire terminations comprises a conductive surface and a resilient member disposed adjacent to the conductive surface. The resilient member has a movable arm, and the movable arm has at least a first and second position. The at least one lever arm manually actuates the movable arm between the at least first and second positions, the first position selectively securing a wire inserted within the at least one wire termination so as to establish electrical communication between the wire and the conductive surface, the second position permitting the wire to be selectively inserted or removed from the at least one wire termination.

In disclosed embodiments, the movable arm is biased towards its first position.

In disclosed embodiments, all exposed surfaces of the electrical distribution wiring device accessible to a human finger are electrically isolated from line voltage.

The present disclosure also relates to a wire termination comprising a collar and a manually operable actuator disposed in mechanical cooperation with the collar and being movable between at least a first position and a second position. Movement of the actuator to the first position actuates the collar such that the collar may receive a wire and movement of the actuator to the second position of the actuator actuates the collar to removably clamp the wire.

The present disclosure also relates to a wire termination comprising a conductive surface and a lever rotationally mounted with respect to the conductive surface and being manually rotatable between at least a first position and a second position. The lever includes an eccentric surface. The first position allows a wire to be inserted into the wire termination and the second position causes the eccentric surface to selectively secure the wire against the conductive surface.

The present disclosure also relates to a wire termination comprising a conductive surface and a resilient member disposed adjacent to the conductive surface, the resilient member having a movable arm, wherein the movable arm has at least a first and second position. The at least one lever arm manually actuates the movable arm between the at least first and second positions, the first position selectively securing a wire inserted within the at least one wire termination so as to establish electrical communication between the wire and the conductive surface, the second position permitting the wire to be selectively inserted or removed from the at least one wire termination.

DESCRIPTION OF THE DRAWINGS

Various embodiments of the present disclosure are disclosed herein with reference to the drawings, wherein.

DETAILED DESCRIPTION

The present disclosure will now be described more fully hereinafter with reference to the accompanying drawings, in which embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art.

Figure 1:
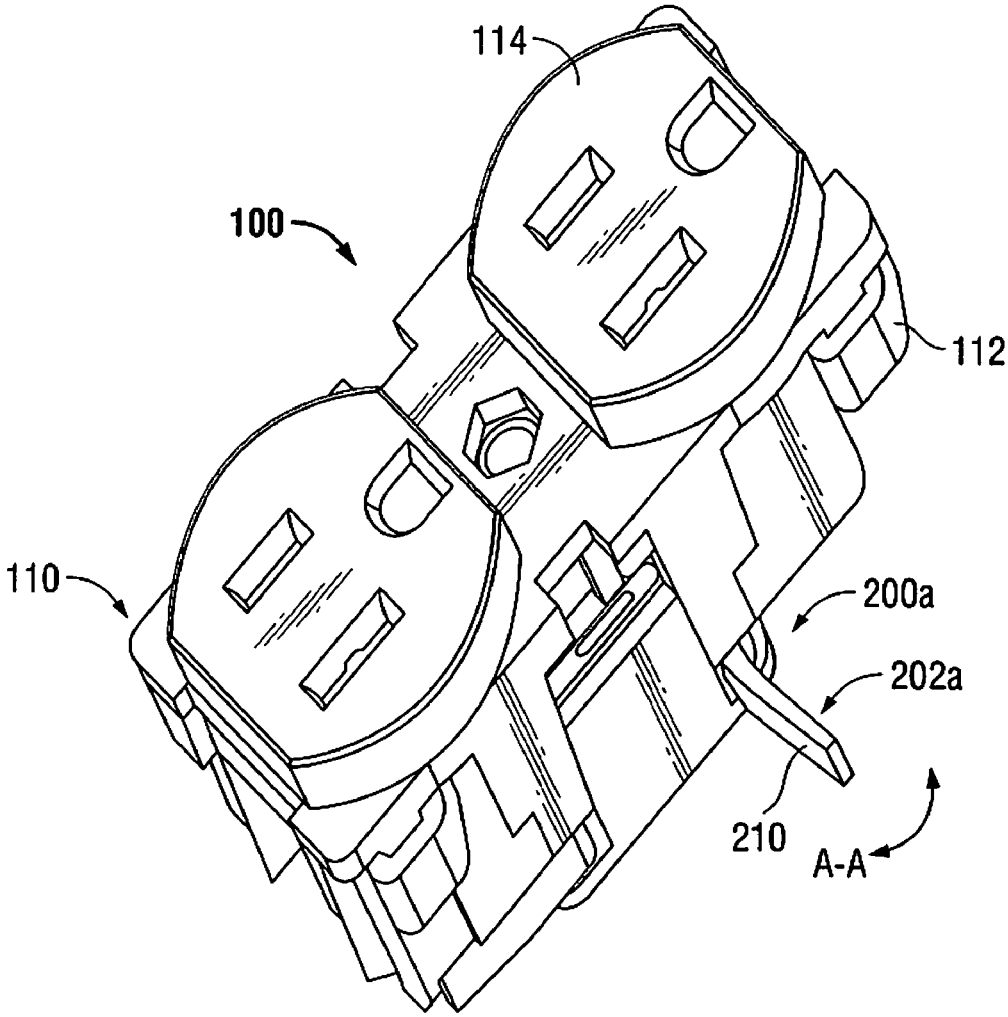
FIG. 1 is a perspective view of a wiring device including a wire termination mechanism according to an embodiment of the present disclosure, shown in a first position.

Referring initially to FIG. 1, an electrical distribution wiring device or wiring device, including at least one wire termination mechanism according to an embodiment of the present disclosure, is generally designated as 100. Wiring device 100 is in the form of an electrical receptacle, in particular, a duplex three-prong electrical receptacle for handling 15 amp current applications. However, it should be understood that the receptacle can be a two- or three-prong electrical receptacle or a receptacle other than that of a duplex receptacle. It should also be understood that the term "wiring device" is intended to include any of the standard electrical devices that are available including but not limited to switches, ground fault circuit interrupters, dimmers, fan speed controls, occupancy sensors, energy management devices, surge suppressors, and the like.

Figure 2:
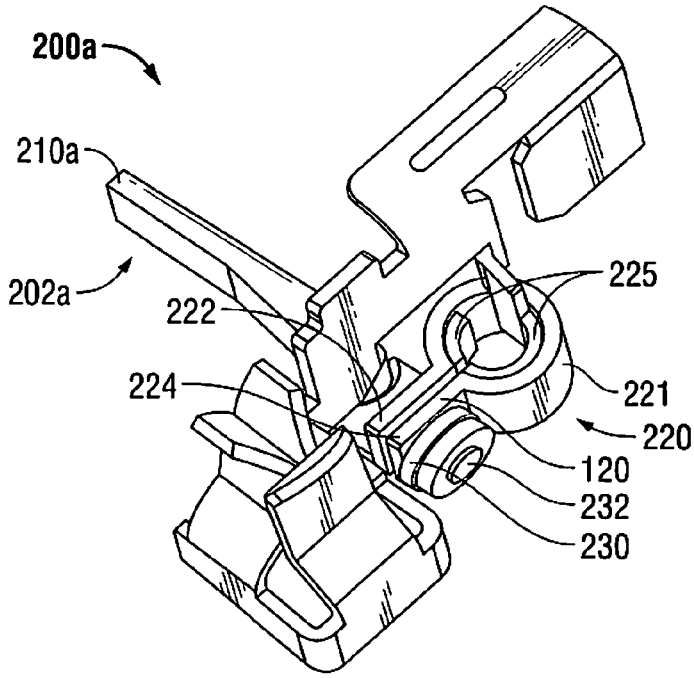
FIG. 2 is an enlarged, perspective view of the wire termination mechanism depicted in the wiring device of FIG. 1, shown in a first position.
Figure 3:
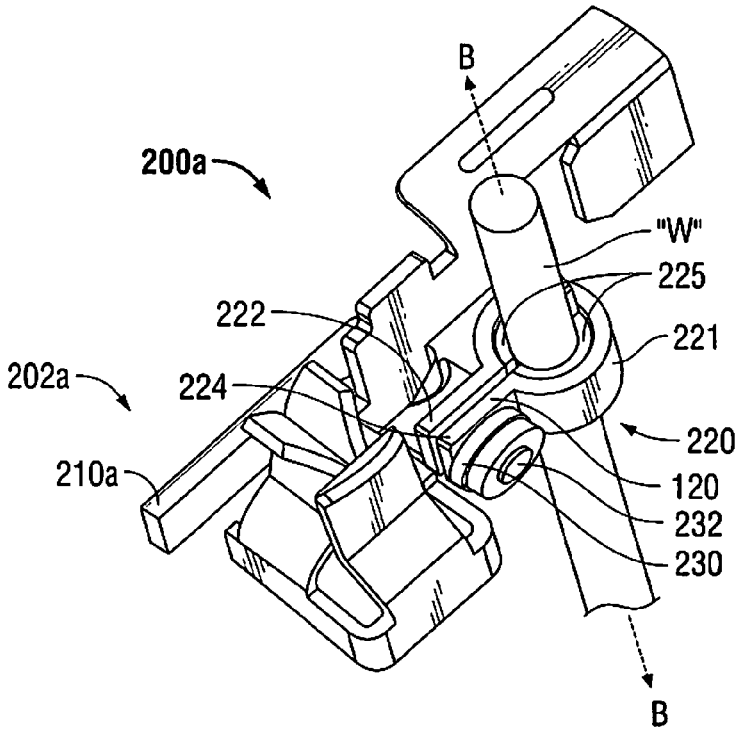
FIG. 3 is an enlarged, perspective view of the wire termination mechanism of FIGS. 1-2, shown in a second position removably securing a wire therein.
Figure 4:
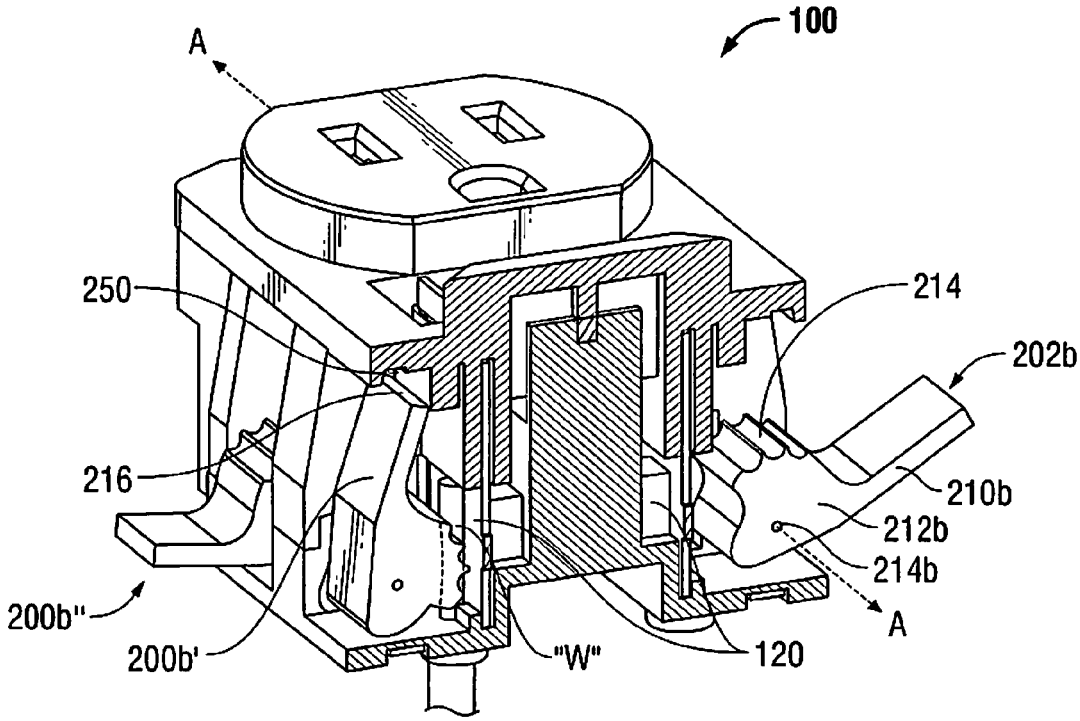
FIG. 4 is an isometric cross-sectional view of a wiring device of another embodiment of the present disclosure illustrating a first wire termination mechanism in a first position and a second wire termination mechanism in a second position.
Figure 5:
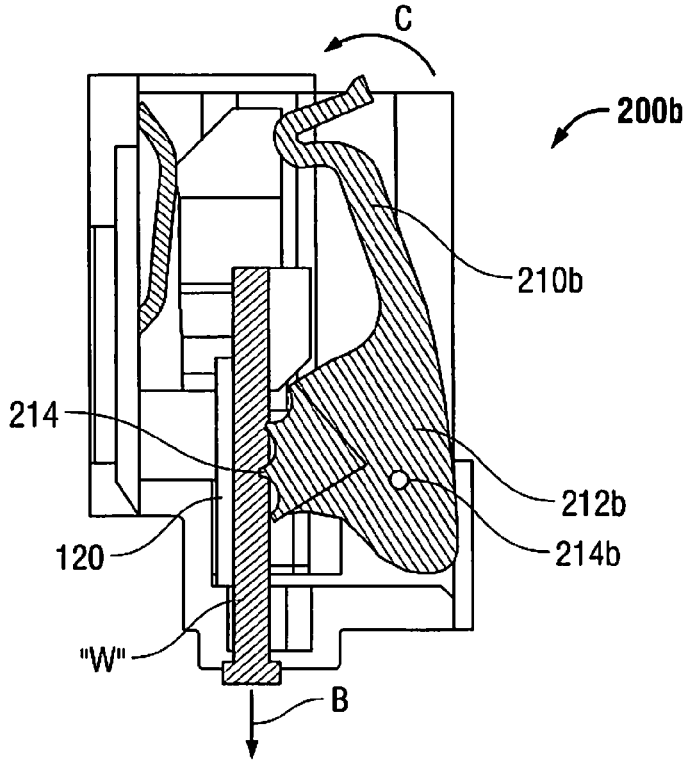
FIG. 5 is a cross-sectional view of a variation of the wire termination mechanism of FIG. 4 illustrated in a second position according to the present disclosure.
Figure 6:
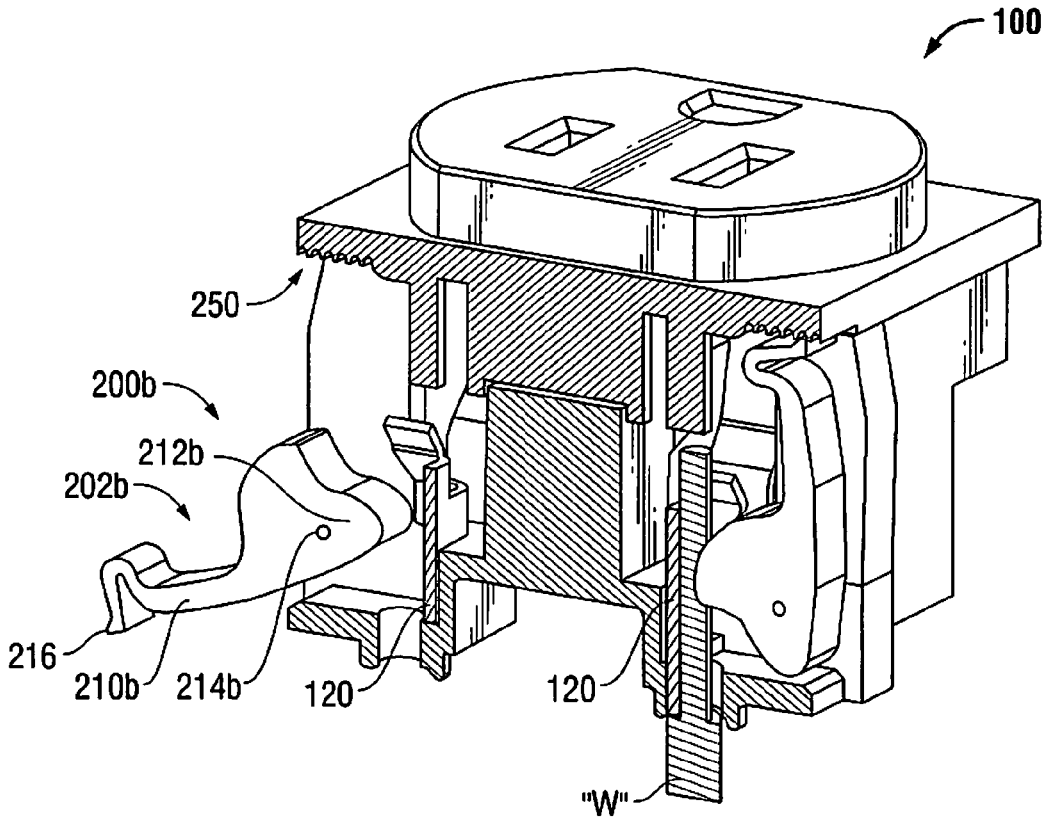
FIG. 6 is a cross-sectional view of a variation of a wiring device according to an embodiment of the present disclosure, illustrating a first wire termination mechanism in a first position and a second wire termination mechanism in a second position.
Figure 7:
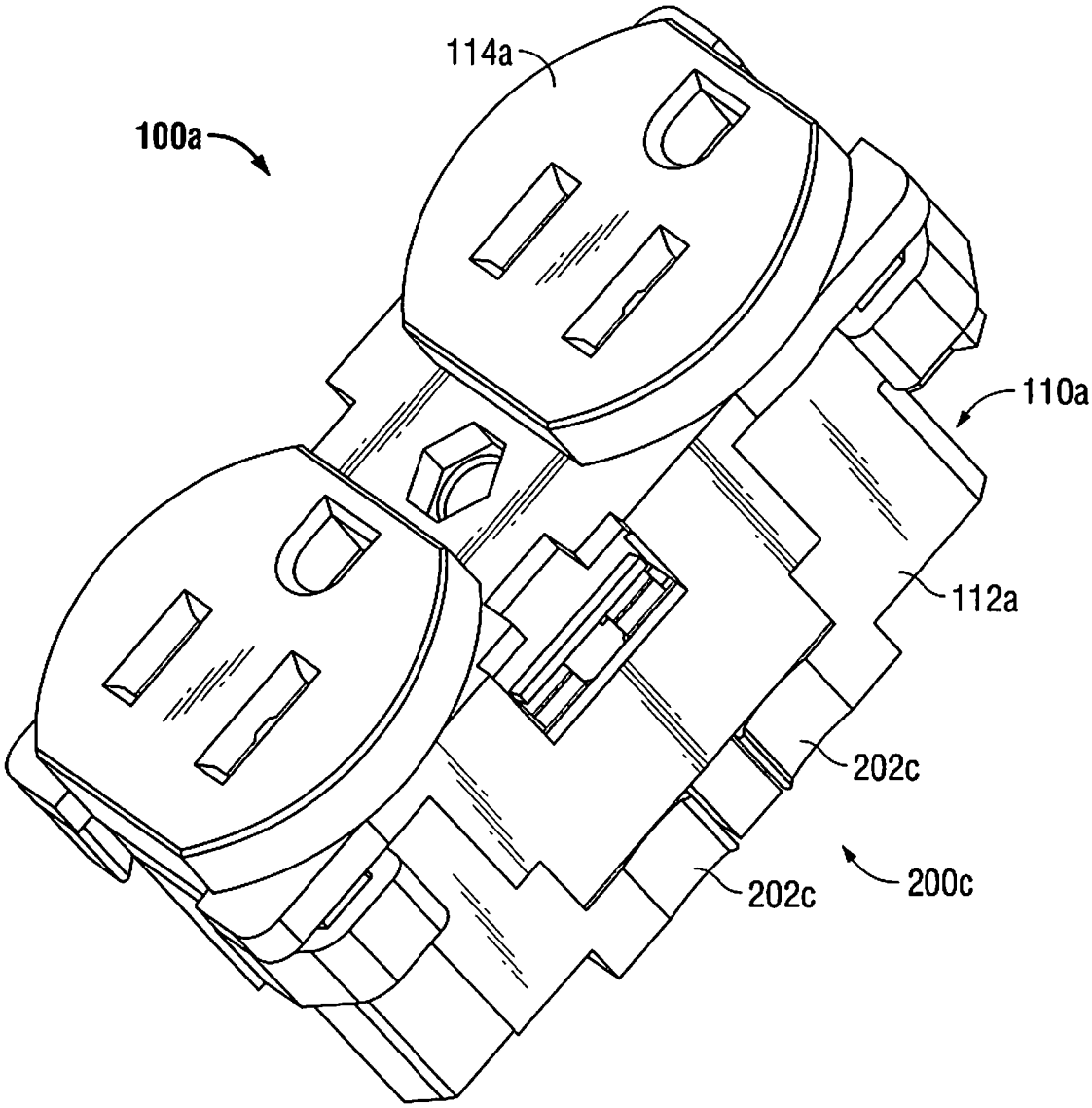
FIG. 7 is an isometric view of another embodiment of a wiring device in accordance with the present disclosure.

With continued reference to FIG. 1, wiring device 100 includes a housing 110 having a base portion 112 and a cover portion 114 configured and dimensioned for connection to and support on base portion 112. Additionally, wiring device 100 includes conductive elements to receive the conductive blades of a typical plug connector and at least one wire termination mechanism assembly, generally referred to as numeral 200. FIGS. 1-3 illustrate a first embodiment of a wire termination mechanism 200*a* and FIGS. 4-6 illustrate a second embodiment of a wire termination mechanism 200*b*. Wire termination mechanism 200 is configured to removably secure a portion of a wire "W" in electrical contact with at least a portion of the conductive elements, thus enabling electrical communication between the conductive elements of wiring device 100 and wire "W."

With reference to FIGS. 2 and 3, wire termination mechanism 200*a* illustrates one disclosed embodiment. Wire termination mechanism 200*a* includes an element (e.g., lever element 202*a*), a conductive surface (e.g. including a collar 220), and at least one nut 230 disposed around an axle 232. As described below, collar 220 includes a circular portion 221 with a pair of walls 222, 224 extending therefrom. As can be appreciated, the circular portion 221 also includes walls. Lever element 202*a* is disposed at least partially within housing 110 and includes a hand-operable lever 210*a* or actuator having a cammed end disposed adjacent to a distal portion of lever 210*a*. Lever element 202*a* may include conductive and/ or non-conductive portions. Additionally, lever 210*a* is actualable (e.g., either with or without a tool or implement) between a first position and a second position. In the current embodiment, lever 210*a* is rotatable about pin 214, where pin 214 defines a first longitudinal axis "A-A" (see FIG. 4). It is envisioned that first longitudinal axis "A-A" extends through an off-center portion of cam 212, i.e., an eccentric cam. Such an eccentric cam would apply a continually increasing amount of force against wire "W" upon movement of lever 210, as discussed below. It is envisioned that through an appropriate shape of cammed end 212, the initial movement of lever 210*a* would require less force than when lever 210*a* is moved to its final position. Therefore, in accordance with this configuration of lever 210*a,* it would take a relatively large amount of force to move lever 210*a* back towards its initial position. Further, actuation of lever 210 from its first position towards its second position causes the distance between the conductive surface 220 and the cam to decrease.

When used herein, the term "tool-lessly" refers to a wire termination mechanism that may be actuated without the need or use of a tool or implement, e.g., hand-operable. This may include the ability to operate/actuate the wire termination mechanism both to secure a wire and to release a wire. However, it should be clear that the actuators of the wire termination mechanisms which are adapted and configured to be manually operable without the need or use of a tool or implement, may still be conceivably operated with a suitably selected tool or implement; i.e., tool-lessly operable wire termination mechanisms do not necessarily exclude manual operation by means of a tool or implement.

FIG. 2 illustrates lever 210*a* in its first position where wire "W" is insertable into the opening of circular portion 221 (i.e., a circumferential opening) of collar 220. FIG. 3 illustrates lever 210*a* in its second position where movement of cam 212 causes compression of the space between walls 222, 224 (i.e., at least one wall is moved towards the other). Further, movement of cam 212 correspondingly causes compression of circular portion 221 of collar 220 to removably secure or clamp wire "W" at least partially within circular portion 221 of collar 220. An electrical connection between wire "W" and wiring device 100 is thus enabled. That is, lever 210*a* is movable in the general direction of arrow "A-A" in FIG. 1. As shown, conductive collar 220 defines a second longitudinal axis "B-B," which is substantially perpendicular to first longitudinal axis "A-A" (see FIG. 3). While the first and second axes are disclosed as being perpendicular to each other, the present disclosure contemplates the two axes being disposed at any suitable angle with respect to one another.

It is envisioned that the thickness and/or number of washers 230 can be varied depending on the gauge of wire "W." That is, for example, when wire termination mechanism 200*a* is configured to accept a #14-AWG wire, two washers 230*a,* 230*b* (as shown in FIGS. 2 and 3) may be used to create a relatively small opening within circular portion 221 of collar 220. That is, upon compression of walls 222, 224 of collar 220, circular portion 221 of collar 220 also compresses. Additionally, for example, when wire termination mechanism 200*a* is configured to accept a #12-AWG wire, a single washer (not explicitly shown in the illustrated embodiments) may be used to create a relatively large opening within circular portion 221 of collar 220. Removal and/or addition of washers 230 may be accomplished by any suitable means, such as by removing a retaining member (e.g., screw) to allow access to washers 230. In the disclosed embodiments, it is envisioned that at least one wall (e.g., 224) of collar 220 is biased away from the other wall (e.g., 222). It is further envisioned that wiring device 100 is configured to be provided with or optionally house extra or non-used washers 230 to facilitate use of the extra washers 230 at a later date.

While only one configuration of collar 220 is shown, it is envisioned that collar 220 is any suitable shape that defines an opening and where the opening is compressible and/or expandable. Additionally, at least a portion of collar 220 may be made from conductive material and/or conductive material may be disposed on at least a portion of collar 220.

As can be appreciated, wire termination mechanism 200*a* facilitates the insertion and removal of wire "W" with respect to wiring device 100. To secure a wire "W" into wire termination mechanism 200*a* of wiring device 100, a user (e.g., a licensed electrician) can position lever 210*a* in its first, open position, insert a portion of wire "W" within circular portion 221 of collar 220, and move lever 210*a* towards its second, closed position, such that cam 212 compresses at least one wall 222, 224 towards the other and compresses circular portion 221 of collar 220, thus firmly securing wire "W" within the circular portion 121. To remove wire "W" from wire termination mechanism 200*a* of wiring device 100, the user tool-lessly moves lever 210*a* from its second, closed position towards its first, open position. This movement of lever 210*a* causes cam 212 to put less pressure on a wall (e.g., 222) of collar 220, such that space within circular portion 221 is expanded, such that wire "W" is free to longitudinally translate within circular portion 221, thus allowing the user to remove the wire "W" from wiring device 100.

Referring now to FIGS. 4-6, wiring device 100 is shown including wire termination mechanism 200*b*. Wire termination mechanism 200*b* of this embodiment includes a lever element 202*b* including a hand-operable lever 210*b* and an eccentric surface 212*b* adjacent a distal portion of lever 210*b*. Lever element 202*b* may include conductive and/or non-conductive portions. Additionally, lever element 202*b* is rotatable (e.g., tool-lessly) about first longitudinal axis "A-A" between a first position and a second position. It is envisioned that first longitudinal axis "A-A" extends through an off-center portion of eccentric surface 212*b*. In this embodiment, rotation of lever element 202*b* from its first position towards its second position causes eccentric surface 212*b* of lever element 202*b* to removably secure a portion of wire "W" in contact with conductive surface 120, thus establishing an electrical connection therebetween. It is envisioned that actuation of lever 210*b* from its first position towards its second position causes the distance between the conductive surface 120 and the eccentric surface 212*b* to decrease.

FIG. 4 illustrates a pair of wire termination mechanisms 200*b*. Here, a first wire termination mechanism 200*b*' is oriented in its first position and a second wire termination mechanism 200*b*" is orientated in its second position with wire "W" in contact with conductive surface 120. With reference to FIGS. 4 and 5, a gripping portion 214 is shown on a portion of eccentric surface 212*b,* which may help facilitate removably securing the wire "W" between element 202*b* and conductive surface 120. Additionally, while not explicitly shown, it would be understood by those in the art that gripping portion 214 may be included on the embodiments of wire termination mechanism 200*a* of FIGS. 1-3. Gripping portion 214 can be integrally formed into the eccentric surface 212*b* of level element 202*b* and can be a separate element which is attached to or arranged on eccentric surface 212*b;* e.g., as an insertable element, as an overlayed element, or the like. Gripping portion 214 may include serrations and/or may include a plurality of raised portions interconnected by a plurality of valleys.

It is envisioned that a spring is disposed in mechanical cooperation with lever element 202*b* to enable removably securing a wire "W" of different gauge thickness between a portion of cam 212*b* and conductive surface 120.

As can be appreciated, wire termination mechanism 200*b* facilitates the insertion and removal of wire "W" with respect to wiring device 100. To secure a wire "W" into wire termination mechanism 200*b* of wiring device 100, a user would, in at least one embodiment, position lever element 202*b* into its first, open position, insert a portion of stripped wire "W" into the space between the eccentric surface 212*b* of lever 210*b* and conductive surface 120 of wiring device 100, and move lever element 202*b* towards its second, closed position, such that eccentric surface 212*b* contacts and firmly secures wire "W" against conductive surface 120. To remove wire "W" from wire termination mechanism 200*b* of wiring device 100, the user would, in disclosed embodiments, move lever element 202*b* from its second, closed position towards its first, open position. This movement of lever element 202*b* causes eccentric surface 212*b* to reduce the contact pressure on wire "W," thus rendering wire "W" free to longitudinally translate adjacent conductive surface 120 and thereby allowing the user to remove the wire "W" from wiring device 100.

As can be appreciated, and as shown in the embodiments illustrated in FIGS. 4 and 6, lever element 202*b* of wire termination mechanism 200*b* may be temporarily locked into place (e.g., in its second position) when a portion of lever 210*b* (e.g., a proximal tip 216) engages a detent 250 (FIG. 4) or at least one of a series of corresponding detents 250 (FIG. 6) disposed on a portion of wiring device 100. At least in reference to the embodiment of FIG. 6, but not necessarily limited to this particular embodiment, actuating lever element 202*b* so as to engage an increasing number of detents allows correspondingly smaller gauges of wires to be removably secured. More specifically, it is envisioned that in at least one preferred embodiment, proximal tip 216 of lever 210*b* is configured to engage a particular detent 250 that corresponds to a particular gauge of wire. Additionally, wiring device 100 may include indicia (e.g., "12-gauge," "14-gauge"; not shown) disposed thereon to label each detent. Further, while not explicitly shown, detents may be included on the embodiments of wire termination mechanism 200*a* of FIGS. 1-3. Moreover, it is envisioned that engagement between proximal tip 216 and detents 250 provides the user with feedback (e.g., tactile or audible) signifying that lever 210 is locked in place.

As can be appreciated with respect to the embodiment illustrated in FIGS. 4-6, the direction of movement of lever 210*b* helps resist pullout forces on wire "W." That is, when lever 210*a* is locked in place securing wire "W," any force acted on wire "W" in the general direction of arrow "B" in FIG. 5 causes a force on lever 210*a* in the general direction of arrow "C" in FIG. 5, which helps prevent lever 210*a* from moving towards the first position. Further, when wire "W" is inserted between conductive surface 120 and lever 210*b*, an axis defined by wire "W" (i.e., along arrow "B") is substantially perpendicular to the first axis "A-A."

FIGS. 7-12 illustrate additional embodiments of the present disclosure. The wiring device 100*a* illustrated in FIGS. 7-12 includes a wire termination mechanism 200*c* including conductive surface 120*a* and lever arm 202*c* disposed in movable relation with respect to conductive surface 120*a*. In the illustrated embodiments, lever arm 202*c* is a portion of housing 110*a* and lever arm 202*c* is tool-lessly movable with respect to other portions of housing 110*a*. For example, lever arm 202*c* is a cantilevered beam, or finger, of housing 110*a*. While illustrated as part of base portion 112*a*, it is envisioned that lever arm 202*c* may alternatively be part of cover portion 114*a*.

Wire termination mechanism 200*c* also includes a resilient member 300*a*, e.g., a cage clamp or the like, disposed in mechanical cooperation with lever arm 202*c*. More specifically, resilient member 300*a* is configured to bias lever arm 202*c* towards its first position (in the general direction of arrow "D" in FIG. 8) and is configured to at least partially block access to conductive surface 120*a* when lever arm 202*c* is in its first position (discussed in more detail below).

Figure 8:
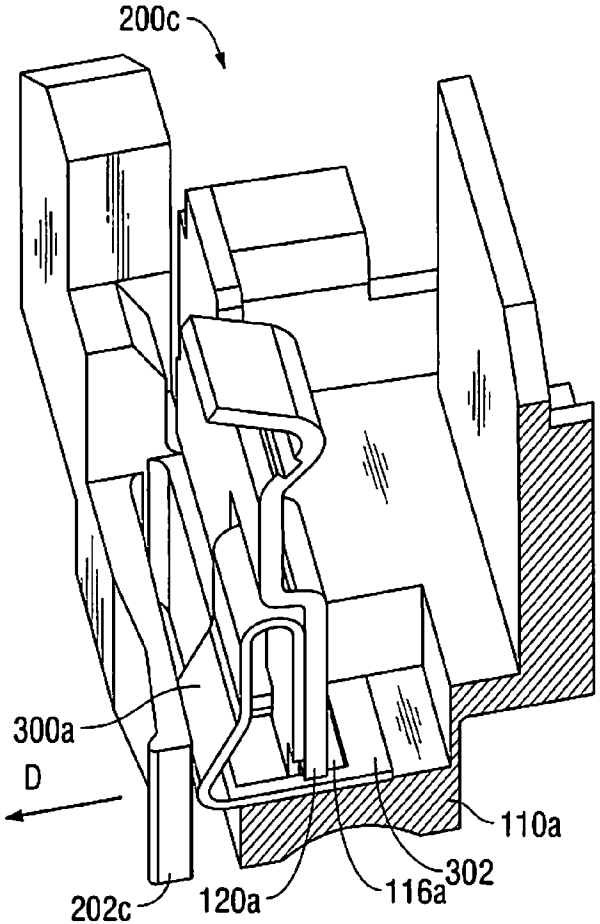
FIG. 8 is a cross-sectional view of the wiring device of FIG. 7 illustrating a wire termination mechanism in a first position.

In FIG. 8, wire termination mechanism 200*c* is illustrated with lever arm 202*c* in its first position. When lever arm 202*c* is in the first position, a movable arm 302 of resilient member 300*a* is in its first position and physically blocks, at least partially, access to the inside portions of housing 110*a* (e.g., conductive surface 120*a*) by covering at least a portion of an aperture 116*a* of housing 110*a*. That is, when lever arm 202*c* is in its first position, a wire is, in disclosed embodiments, prevented from entering through aperture 116*a* of housing 110*a*. Additionally, while not explicitly shown in all of the illustrated embodiments, it is envisioned that, in any or all of the disclosed embodiments, the housing of the wiring device includes at least one aperture, through which a wire "W" is insertable.

Figure 9:
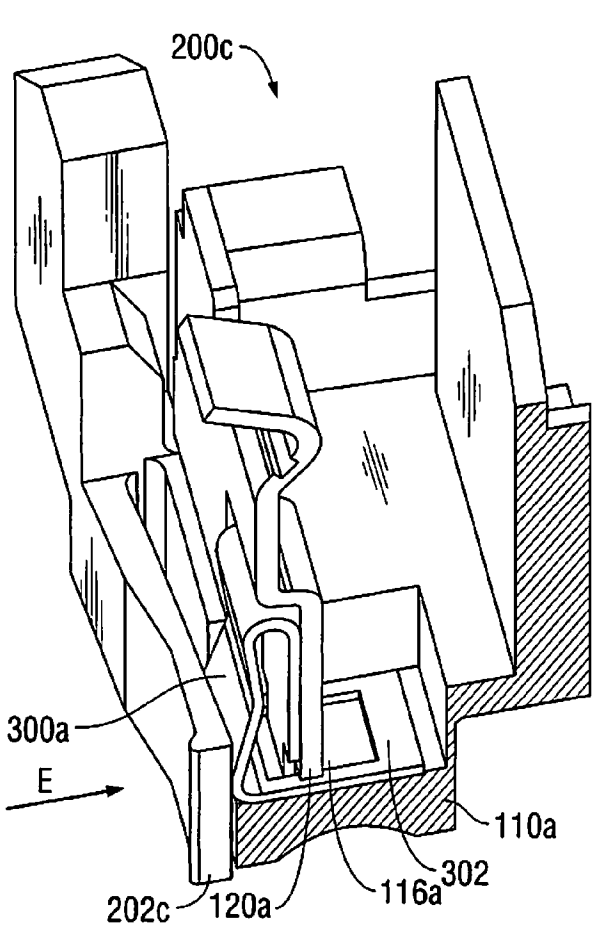
FIG. 9 is a cross-sectional view of the wiring device of FIG. 7 illustrating a wire termination mechanism in a second position.

Referring to FIG. 9, to move lever arm 202*c* towards its second position, a user would exert a force (e.g., using his or her hand/fingers) against lever arm 202*c* in the general direction of arrow "E" in FIG. 9. In response to a sufficient amount of force, lever arm 202*c* moves in the general direction of arrow "E," thus causing at least a portion of resilient member 300*a* (e.g., movable arm 302) to move in the general direction of arrow "E." Upon movement of a portion of resilient member 300*a*, movable arm 302 moves from covering aperture 116*a* to a position where wire "W" is able to enter housing 110*a* through aperture 116*a* (as shown in FIG. 10).

The lever arm 202*c* tool-lessly actuates the movable arm 302 between the first and second positions. In its first position, movable arm 302 secures a wire inserted within wire termination mechanism 200*c* so as to establish electrical communication between the wire "W" and conductive surface 120*a*. It its second position, movable arm 302 permits the wire "W" to be inserted or removed from wire termination mechanism 200*c*. It is envisioned that movable arm 302 is biased towards its first position. It is also envisioned that when in its first position, movable arm 302 prevents a wire from entering housing 110*a* through aperture 116*a*. It is further envisioned that all exposed surfaces of the electrical distribution wiring device 100*a* are electrically isolated from line voltage when movable arm 302 is in its first position.

Figure 10:
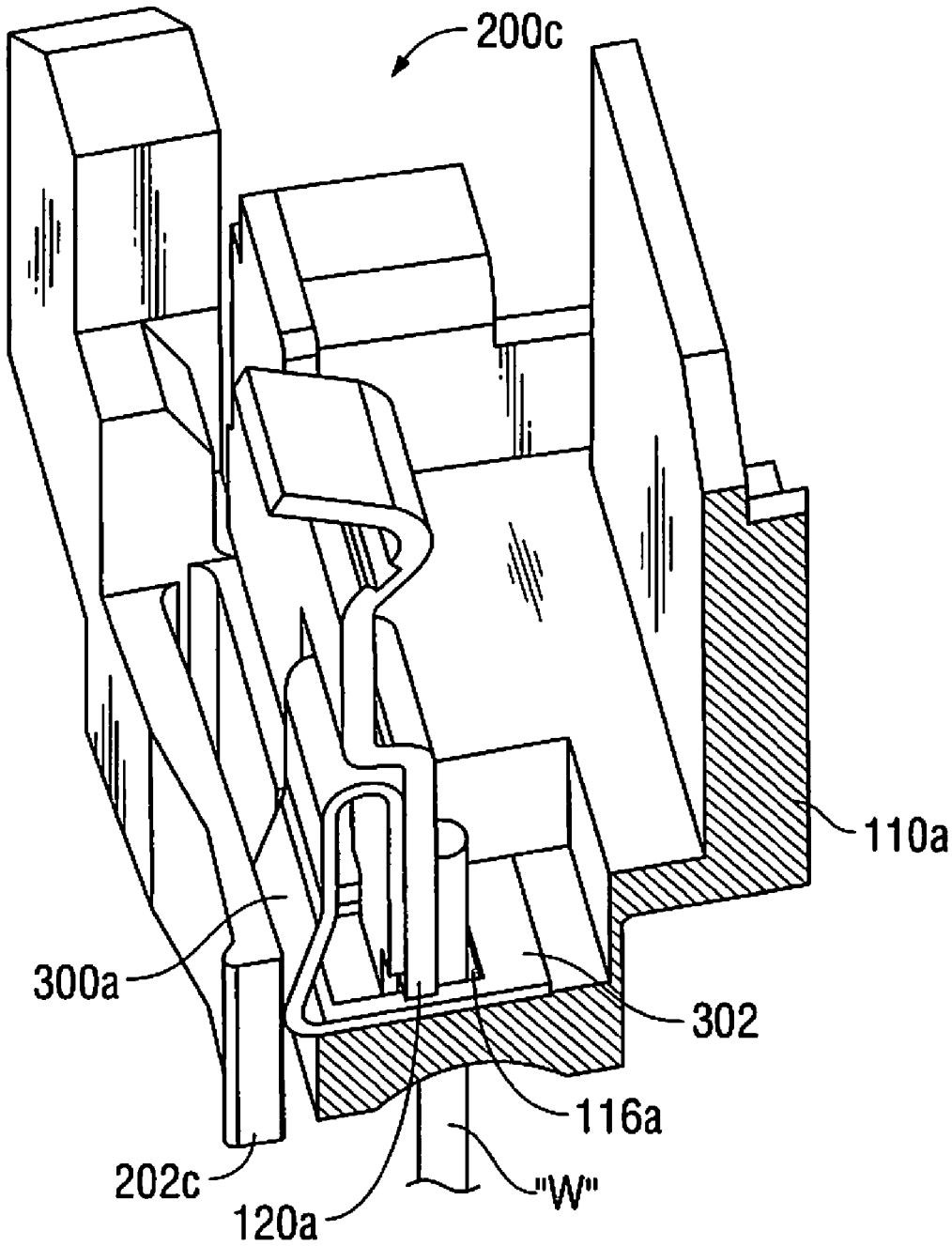
FIG. 10 is a cross-sectional view of the wiring device of FIG. 7 illustrating the wire termination mechanism removably securing a wire therein.

With reference to FIG. 10, a portion of wire "W" is shown through aperture 116*a* of housing 110*a*, and in contact with conductive surface 120*a* and movable arm 302 of resilient member 300. Here, lever arm 202*c* is between its first position (FIG. 8) and its second position (FIG. 9). Due to the bias of resilient member 300*a* in the general direction of arrow "D," wire "W" is compressed between movable arm 302 and conductive surface 120*a*.

Figure 11:
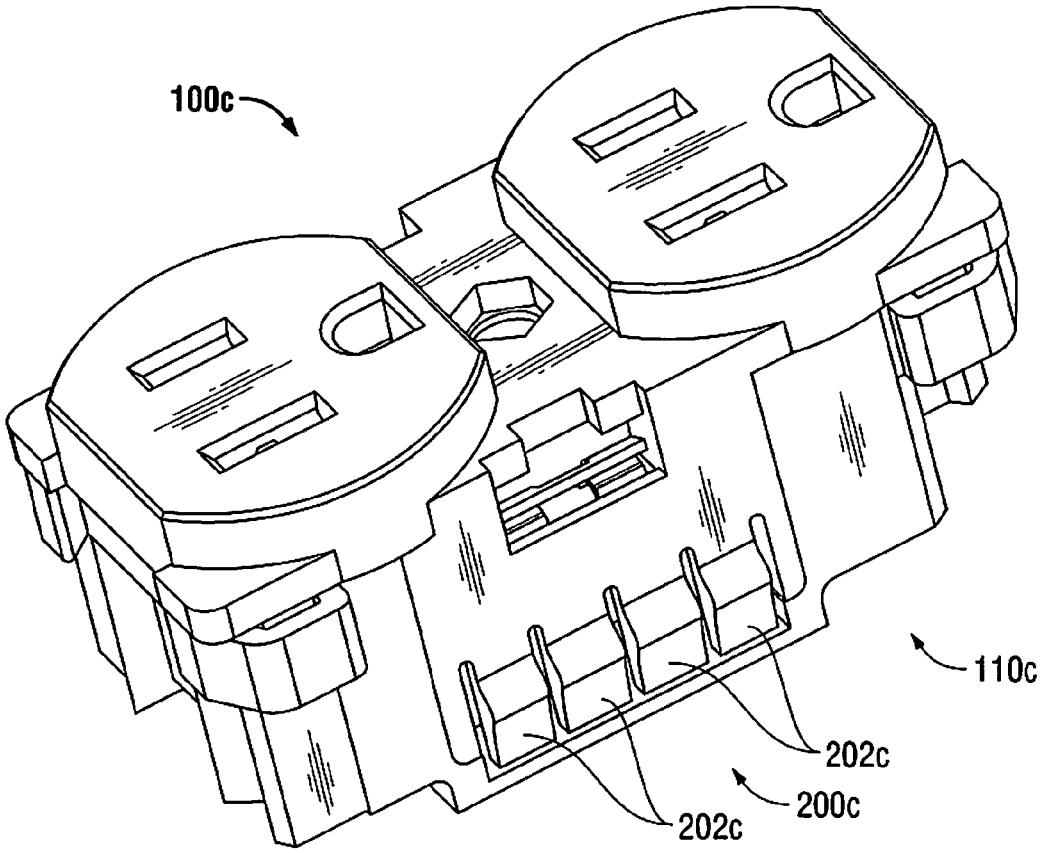
FIG. 11 is an isometric view of an alternative embodiment of the wiring device of FIG. 7 illustrating multiple wire termination mechanisms such as the mechanism depicted in FIGS. 8-10.

As can be appreciated, wire termination mechanism 200*c* can be configured to accept wires of a single gauge (e.g., 12-gauge or 14-gauge) or wires of varying gauges. Additionally, wiring device 100*b* may include wire termination mechanism 200*c* including multiple fingers 202*c* (and corresponding resilient members 300*a* (not shown)), as shown in FIG. 11, such that multiple wires "W" can be independently (or multiple wires together; not shown) inserted through a respective aperture in housing 110*b* to make contact with the conductive surface. In a disclosed embodiment, all exposed surfaces (i.e., surfaces that can be touched with a human finger, a tool such as a screwdriver, exposed wires, etc.) of wiring device 100*b* having wire termination mechanism(s) 200*c* are either made of non-conductive materials and/or are electrically isolated from line voltage.

Figure 13:
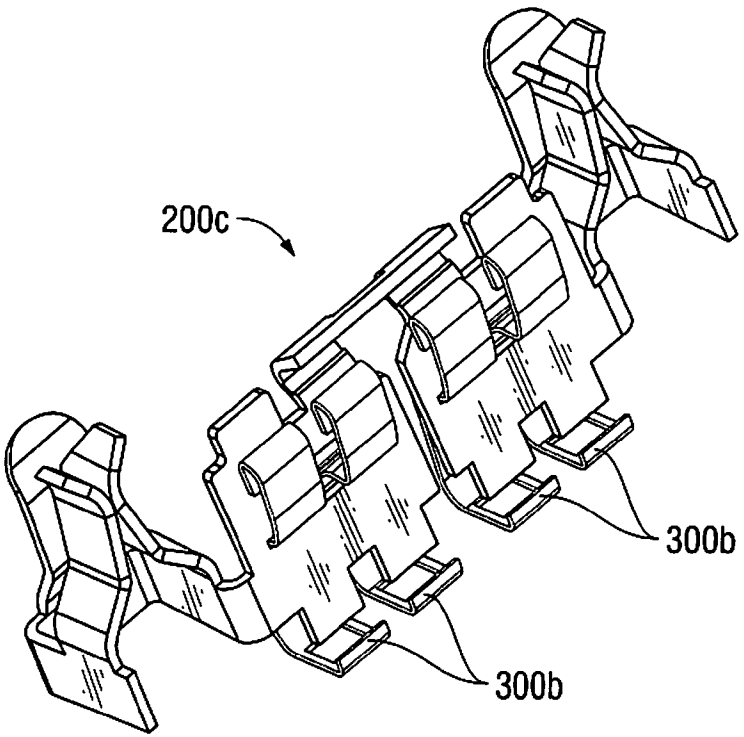
FIGS. 12 and 13 are perspective views of an alternate embodiment of a portion of the wire termination mechanism of FIGS. 7-11.
Figure 12:
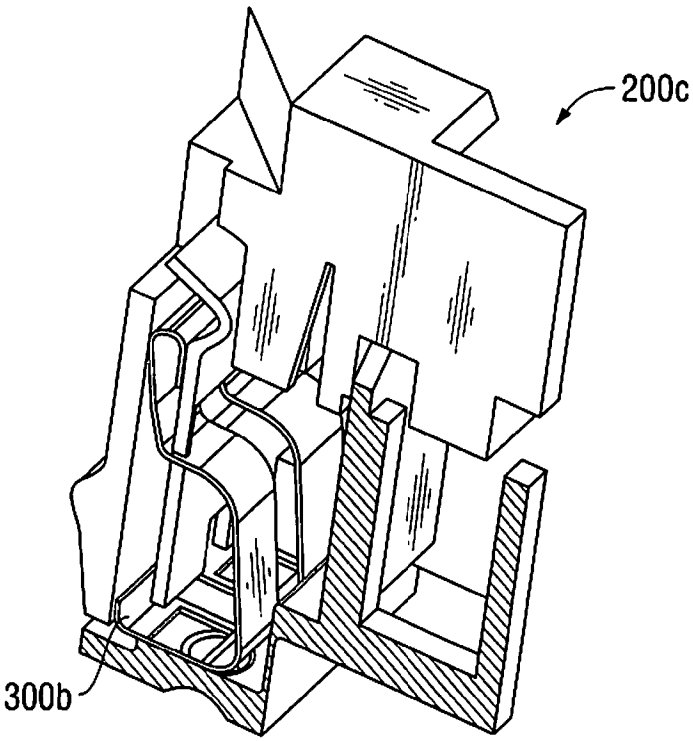

FIGS. 12 and 13 illustrate wire termination mechanism 200*c* including several resilient members 300*b*. While the configuration of resilient member 300*b* differs from the configuration of resilient member 300*a*, the function of both resilient members 300*a*, 300*b* is substantially the same. Resilient members having configurations other than the configurations of resilient members 300*a*, 300*b* are also contemplated by the present disclosure. Additionally, resilient members 300*a*, 300*b* may be made of any conductive material, non-conductive material, or any suitable combination of conductive and non-conductive materials.

Figure 14:
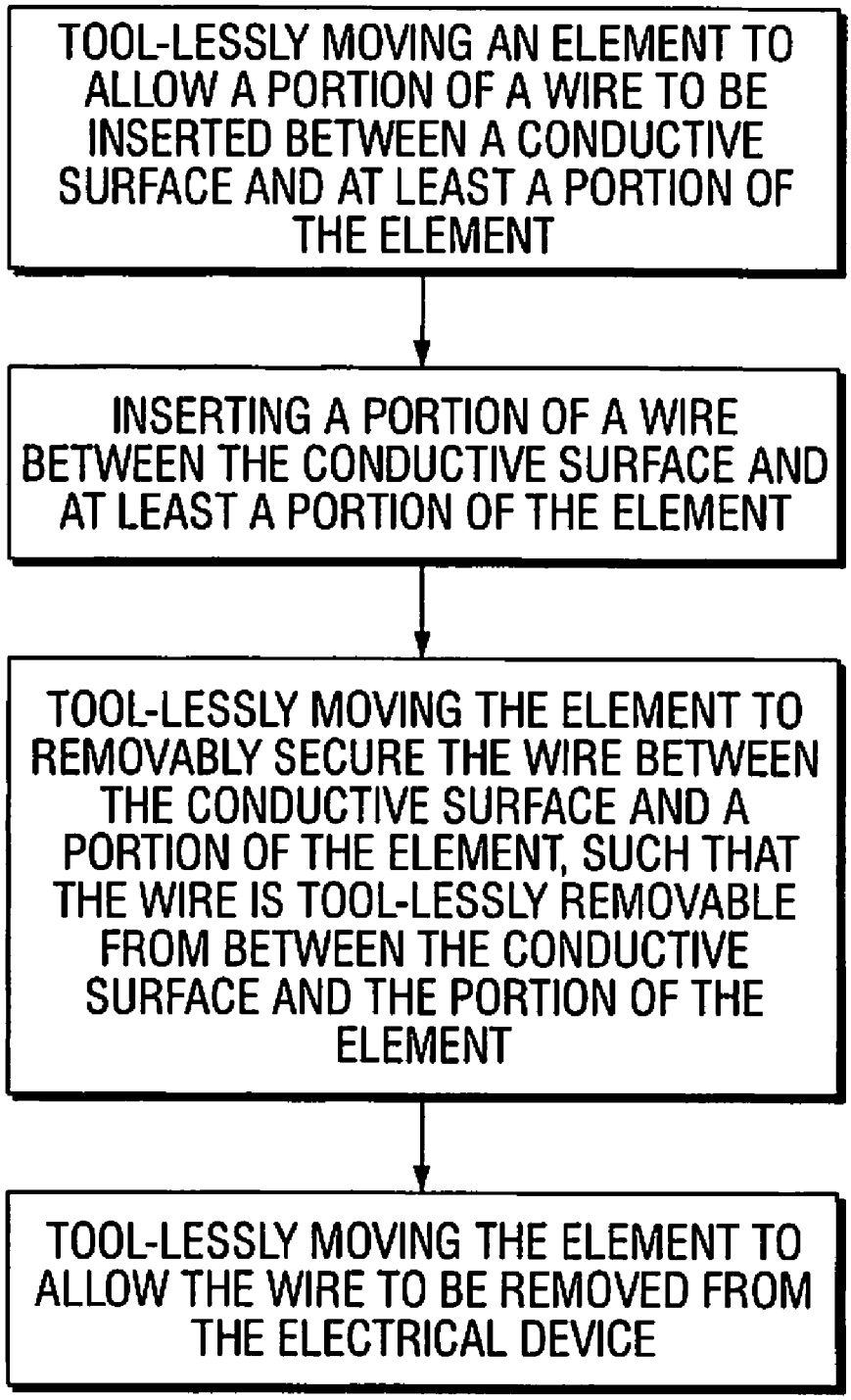
FIG. 14 is a flow chart illustrating a method of electrically coupling a conductor with an electrical wiring device, in accordance with various embodiments of the present disclosure.

The present disclosure also relates to a method for terminating a source of power to an electrical device 100, 100*a*, 100*b* (see FIG. 14). The method includes the steps of tool-lessly moving an element (e.g., 202*a*, 202*b*, 202*c*) to allow a portion of a wire to be inserted between a conductive surface 120, 120*a* and at least a portion of the element (e.g., 202*a*, 202*b*, 202*c*); inserting a portion of a wire between the conductive surface 120, 120*a* and at least a portion of the element (e.g., 202*a*, 202*b*, 202*c*); and tool-lessly moving the element (e.g., 202*a*, 202*b*, 202*c*) to removably secure the wire between the conductive surface 120, 120*a* and a portion of the element (e.g., 202*a*, 202*b*, 202*c*), such that the wire is tool-lessly removable from between the conductive surface 120, 120*a* and the portion of the element (e.g., 202*a*, 202*b*, 202*c*).

Another step of the method includes tool-lessly moving the element (e.g., 202*a*, 202*b*, 202*c*) to allow the wire to be removed from the electrical device 100, 100*a*, 100*b*. Additionally, the step of tool-lessly moving the element (e.g., 202*a*, 202*b*, 202*c*) to removably secure the wire between the conductive surface 120 and a portion of the element (e.g., 202*a*, 202*b*, 202*c*) may also cause a cam surface (e.g., 212) of the element (e.g., 202*a*, 202*b*, 202*c*) to move closer to the conductive surface 120, 120*a*.

While several embodiments of the disclosure have been shown in the drawings and/or discussed herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments.

What is claimed is:

1. An electrical distribution wiring device for installation in and connection to a wallbox configured for mounting in a wall, the wiring device comprising:

a housing having a plurality of wire terminations, the housing adapted and configured to be removably mounted in the wallbox;

at least one of the plurality of wire terminations comprising:

a conductive surface at least partially disposed within said housing; and a lever rotationally mounted to the housing and being manually rotatable between at least a first position and a second position, the lever including an eccentric surface;

wherein the first position allows a wire to be inserted into the wire termination and the second position causes the eccentric surface to selectively secure the wire against the conductive surface; and wherein an upper portion of the lever securedly engages to at least one interaction element disposed on a portion of the wiring device, such that a lower portion of the lever directly engages and secures the wire when the interaction element and the upper portion of the lever are securedly engaged.

2. The electrical distribution wiring device of claim 1, wherein at least a portion of the lever is non-conductive.

3. The electrical distribution wiring device of claim 1, wherein the lever is rotatable with respect to the conductive surface about a first axis.

4. The electrical distribution wiring device of claim 1, the wire termination having a second axis defined in relation thereto, wherein an axis of the wire is substantially co-linear with the second axis when the wire is selectively inserted between the conductive surface and the lever.

5. The electrical distribution wiring device of claim 4, wherein the first axis is substantially perpendicular to the second axis.

6. The electrical distribution wiring device of claim 1, wherein actuation of the lever from its first position towards its second position causes the distance between the conductive surface and the eccentric surface to decrease.

7. The electrical distribution wiring device of claim 6, further comprising a resilient member disposed in mechanical cooperation with the lever, the resilient member being configured to accommodate a plurality of wire gauges.

8. The electrical distribution wiring device of claim 1, wherein at least a portion of the eccentric surface is a wire-contacting surface having a gripping portion thereon to removably secure the wire between the wire-contacting portion and the conductive surface.

9. The electrical distribution wiring device of claim 8, wherein the gripping portion includes a plurality of raised projections.

10. The electrical distribution wiring device of claim 1, wherein the lever is manually rotatable by hand.

11. The electrical distribution wiring device of claim 1, wherein at least two of the plurality of wire terminations are substantially symmetrically positioned on the housing with respect to a longitudinal axis of the housing.

12. The electrical distribution wiring device of claim 1, wherein the lever is manually and tool-lessly rotatable between the first position and the second position.

13. The electrical distribution wiring device of claim 1, wherein at least one of the plurality of wire terminations is configured for being electrically connected to a load when an electrical plug is inserted within the housing.

14. A method for terminating a wire to an electrical distribution device for installation in and connection to a wallbox configured for mounting in a wall, the method comprising:

removably mounting a housing of the electrical distribution device in the wallbox;

manually moving an element to allow a portion of a wire to be inserted between a conductive surface and at least a portion of the element;

inserting a portion of a wire between the conductive surface and the element; and manually moving the element to removably secure the wire between the conductive surface and the element such that the wire is manually removable from between the conductive surface and the element;

wherein an upper portion of the element securedly engages to at least one interaction element disposed on a portion of the electrical distribution device, such that a lower portion of the element directly engages and secures the wire when the interaction element and the upper portion of the element are securedly engaged.

15. The method of claim 14, further comprising the step of manually moving the element to allow the wire to be removed from the electrical device.

16. The method of claim 14, wherein the step of manually moving the element to secure the wire between the conductive surface and a portion of the element causes an eccentric surface of the element to move closer to the conductive surface.

17. The method of claim 14, wherein the step of manually moving the element comprises moving the element by hand.

18. The method of claim 14, wherein the electrical distribution device includes a plurality of wire terminations, and wherein at least two of the plurality of wire terminations are substantially symmetrically positioned on the housing with respect to a longitudinal axis of the housing.

19. The method of claim 14, wherein the element is manually and tool-lessly moved to allow the portion of the wire to be inserted between the conductive surface and the at least the portion of the element, and wherein the element is manually and tool-lessly moved to removably secure the wire between the conductive surface and the element.

20. The method of claim 14, wherein the wire is received by the wiring device through an opening of the wallbox.

21. A wire termination for installation in and connection to a wallbox configured for mounting in a wall, the wire termination comprising:

a conductive surface; and a lever rotationally mounted with respect to the conductive surface and being manually rotatable between at least a first position and a second position, the lever including an eccentric surface;

wherein the first position allows a wire to be inserted into the wire termination and the second position causes the eccentric surface to selectively secure the wire against the conductive surface;

wherein an upper portion of the lever securedly engages to at least one interaction element disposed on a portion of a wiring device mechanically cooperating with the wire termination, such that a lower portion of the lever directly engages and secures the wire when the interaction element and the upper portion of the lever are securedly engaged; and wherein the wire termination is included within a housing adapted and configured to be removably mounted in the wallbox.

22. The wire termination of claim 21, wherein another wire termination is included within the housing and is substantially in symmetrical alignment with respect to the wire termination via a longitudinal axis of the housing.

23. The wire termination of claim 21, wherein the lever is manually and tool-lessly rotatable between the at least the first position and the second position.

* * * * *